US007182001B2

(12) United States Patent
Rivera

(10) Patent No.: US 7,182,001 B2
(45) Date of Patent: Feb. 27, 2007

(54) TOOL FRAME MEMBER INCLUDING SPRING

(75) Inventor: Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 124 days.

(21) Appl. No.: 10/066,087

(22) Filed: Jan. 30, 2002

(65) Prior Publication Data

US 2003/0140740 A1 Jul. 31, 2003

(51) Int. Cl.
*B25G 1/08* (2006.01)

(52) U.S. Cl. ..... 81/177.4; 81/427.5; 7/168; 7/128; 30/159

(58) Field of Classification Search ..... 81/124.4, 81/177.4, 440, 427.5; 7/128, 118, 168, 158; 70/456 R; D8/105, 99.1, 107, 1, 99; 30/156–161, 30/152, 153
See application file for complete search history.

(56) References Cited

U.S. PATENT DOCUMENTS

| | | | | |
|---|---|---|---|---|
| 187,483 | A | 2/1877 | Rightor | |
| 237,138 | A * | 2/1881 | Slayton | |
| 239,068 | A * | 3/1881 | Slayton | |
| 345,296 | A | 7/1886 | Friebertshauer | |
| 364,414 | A * | 6/1887 | Hollweg | 30/160 |
| 610,530 | A * | 9/1898 | Hammesfahr | 81/3.35 |
| 825,093 | A * | 7/1906 | Watson | 30/161 |
| 1,179,111 | A | 4/1916 | Knowlton | |
| 1,273,026 | A * | 7/1918 | Brown | 81/3.35 |
| 1,365,487 | A * | 1/1921 | Hallvarson | 30/155 |
| 1,800,843 | A * | 4/1931 | Moulton | 70/456 R |
| 2,597,540 | A | 5/1952 | Smith | |
| 2,718,695 | A | 9/1955 | Elsener | |
| 2,809,384 | A * | 10/1957 | Kayser | 7/118 |
| 3,363,315 | A * | 1/1968 | Anderson | 30/152 |
| 3,832,775 | A | 9/1974 | Stahel, II et al. | |
| 4,187,607 | A * | 2/1980 | Simuro et al. | 30/152 |
| 4,238,862 | A | 12/1980 | Leatherman | |
| 4,512,051 | A | 4/1985 | Magan | |

(Continued)

FOREIGN PATENT DOCUMENTS

DE 298 04 642 U 7/1998

(Continued)

OTHER PUBLICATIONS

RCE "Magnum" fish gripper, on sale at least as early as 1990, package and photographs.

(Continued)

*Primary Examiner*—Hadi Shakeri
(74) *Attorney, Agent, or Firm*—Chernoff, Vilhauer, McClung & Stenzel, LLP

(57) ABSTRACT

A frame member for the handle of a folding knife or multipurpose tool includes an integral flange with an integral leaf spring. Frames are shown in the form of a channel with an integral external flange extending outwardly from the top of a channel wall in a direction away from the channel. Pivot pins extending through the channel and out the channel wall carry pivoting tool blades. An integral leaf spring on the external flange bears against the base of a blade pivotably connected to the frame outside of the channel. Other tool blades are carried inside the channel and pivot about the pivot pin.

15 Claims, 6 Drawing Sheets

U.S. PATENT DOCUMENTS

| | | | |
|---|---|---|---|
| 4,744,272 | A | 5/1988 | Leatherman |
| 4,759,645 | A | 7/1988 | Kuo |
| 4,805,303 | A | 2/1989 | Gibbs |
| 4,888,869 | A | 12/1989 | Leatherman |
| 5,142,721 | A | 9/1992 | Sessions et al. |
| 5,212,844 | A | 5/1993 | Sessions et al. |
| 5,267,366 | A | 12/1993 | Frazer |
| 5,511,310 | A | 4/1996 | Sessions et al. |
| 5,537,750 | A | 7/1996 | Seber et al. |
| D382,182 | S | 8/1997 | Seber et al. |
| 5,653,525 | A | 8/1997 | Park |
| D385,168 | S | 10/1997 | Rivera |
| 5,697,114 | A | 12/1997 | McIntosh et al. |
| 5,745,997 | A | 5/1998 | Berg et al. |
| 5,765,247 | A | 6/1998 | Seber et al. |
| D403,944 | S | 1/1999 | Rivera |
| D405,675 | S | 2/1999 | Rivera |
| D406,508 | S | 3/1999 | Rivera |
| D406,509 | S | 3/1999 | Rivera |
| D410,828 | S | 6/1999 | Rivera |
| 5,978,993 | A | 11/1999 | Rivera |
| 5,979,059 | A | 11/1999 | Leatherman et al. |
| D417,601 | S | 12/1999 | Rivera |
| 6,006,385 | A | 12/1999 | Kershaw et al. |
| 6,014,787 | A | 1/2000 | Rivera |
| 6,038,735 | A | 3/2000 | Chang |
| D428,791 | S | 8/2000 | Anderson et al. |
| D429,989 | S | 8/2000 | Rivera |
| 6,098,225 | A | 8/2000 | McIntosh et al. |
| 6,105,189 | A | 8/2000 | Nabors et al. |
| 6,128,805 | A | 10/2000 | Rivera |
| D446,709 | S | 8/2001 | Rivera |
| D447,041 | S | 8/2001 | Rivera |
| 6,289,768 | B1 | 9/2001 | Anderson et al. |
| 6,293,018 | B1 | 9/2001 | Rivera |
| 6,341,423 | B1 | 1/2002 | Taggart et al. |
| 6,389,625 | B1 | 5/2002 | Rivera |
| 6,412,130 | B1 * | 7/2002 | Kershaw et al. ..... 7/128 |
| 6,430,768 | B2 | 8/2002 | McIntosh |
| D470,031 | S | 2/2003 | Rivera |
| 6,622,328 | B2 | 9/2003 | Rivera |

FOREIGN PATENT DOCUMENTS

| | | |
|---|---|---|
| DE | 298 04 642 U 1 | 7/1998 |
| EP | 0 771 622 A1 | 5/1997 |
| EP | 0 783 937 A2 | 7/1997 |
| EP | 1 023 971 A3 | 11/2000 |
| EP | 1 116 557 A2 | 7/2001 |
| EP | 1 340 597 B1 | 12/2004 |
| FR | 2 655 635 | 6/1991 |
| FR | 2 760 955 | 9/1998 |
| WO | WO 97/19787 | 6/1997 |
| WO | WO 98/18599 | 5/1998 |

OTHER PUBLICATIONS

Folding scissors with chain, on sale at least as early as 1994, photographs.

Photographs labeled A-K, of Fiskars, Inc.'s Excalibur Multi-Snip tool kit originally disclosed in applicant's Apr. 30, 2002 Supplemental Information Disclosure Statement The handle shown in images A-E is S-shaped, having a pair of side-by-side oppositely facing channels sharing a common channel wall. The respective channel floors each have a single integral leaf spring at one end of the channel. The handle shown in images F-K is S-shaped having a pair of side-by-side oppositely facing channels sharing a common channel wall. The floor of one channel has an integral leaf spring at one end.

Photographs, labeled A-C, of Gerber multi-function tool having channel-shaped handle with a leaf spring in the channel. The channel walls are rolled tightly inwardly to present a smoother surface to the hand.

U.S. Appl. No. 09/703,369, filed Jun. 18, 2000, Rivera.

U.S. Appl. No. 10/062,759, filed Jun. 18, 2000, Rivera.

Fiskars, Inc. "Multi-Snip Tool Kit", Aug. 1996.

* cited by examiner

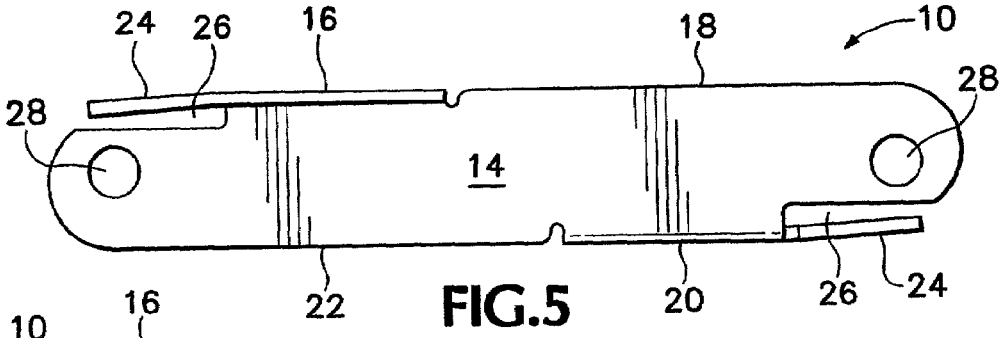
FIG.5
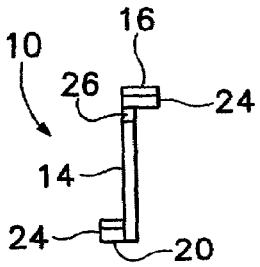
FIG.4
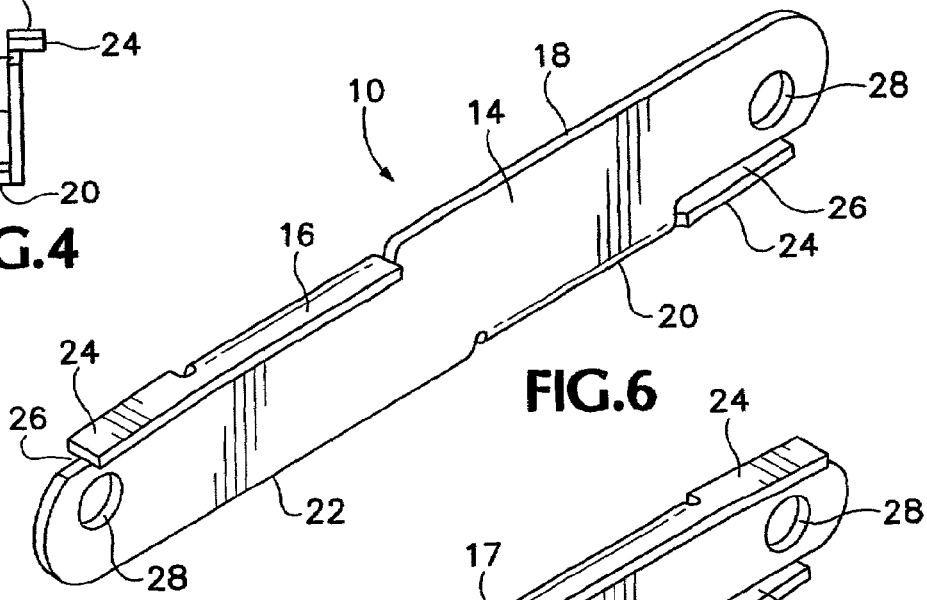
FIG.6
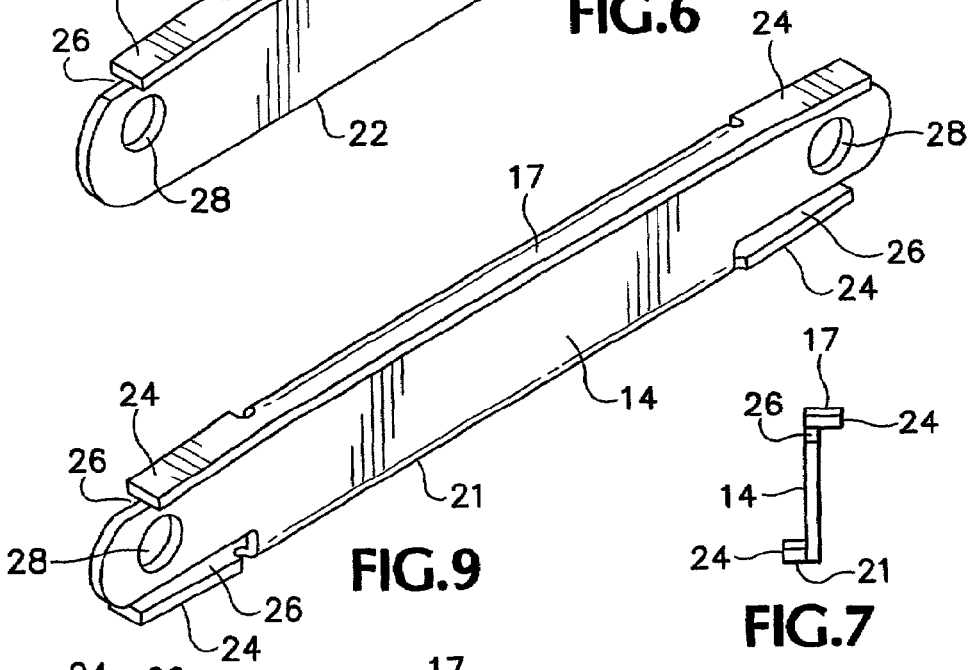
FIG.9
FIG.7
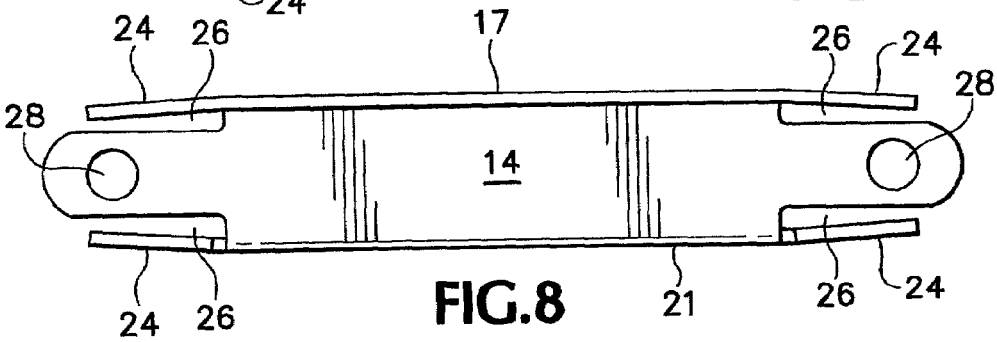
FIG.8

TOOL FRAME MEMBER INCLUDING SPRING

BACKGROUND OF INVENTION

The present invention relates to implements such as knives and tools having folding blades or tool bits, and particularly to a frame member having a flange including an integral leaf spring.

Most folding knives or tools have a spring of some fashion which interacts with a folding blade or bit to hold the blade or bit in folded or extended position relative to the handle. Such springs are typically biased to bear against the cam-shaped base of the folding blade or bit. The cam on the base is shaped such that increased force is required to move the blade or bit into or out of extended or folded position. The spring also applies a frictional force to the base as the blade or bit is being moved between folded and extended positions. For example, traditional folding pocket knives include an independent back spring, separate from and fastened to the frame or scales of the knife, that bears against the base of the blade. Folding multipurpose tools such as shown in U.S. Pat. Nos. 4,238,862, 5,697,114, 5,745,997 and 6,293,018 employ leaf springs, integral with a portion of the tool frame, to bear against the base of a blade or bit. These leaf springs are typically cut from a portion of a frame member and are located within a channel formed by one or more frame members. The folding multipurpose tool shown in U.S. Pat. No. 5,745,997 includes both an integral leaf spring and two independent beam springs arranged within a channel-shaped frame member. U.S. Pat. No. 6,014,787 discloses integral leaf springs located in the floor and sidewall of a channel-shaped frame member.

BRIEF DESCRIPTION OF THE INVENTION

The present invention provides a new folding tool frame member having a flange with an integral leaf spring.

The foregoing and other objectives, features, and advantages of the invention will be more readily understood upon consideration of the following detailed description, taken in conjunction with the accompanying drawings.

BRIEF DESCRIPTION OF THE SEVERAL VIEWS OF THE DRAWINGS

FIGS. 4, 5 and 6 are three views, respectively an end view, side view and isometric view, of the frame embodiment of FIG. 1.

FIGS. 7, 8 and 9 are three views, respectively an end view, side view and isometric view, of the frame embodiment of FIG. 2.

DETAILED DESCRIPTION OF THE PREFERRED EMBODIMENTS

Figure 1:
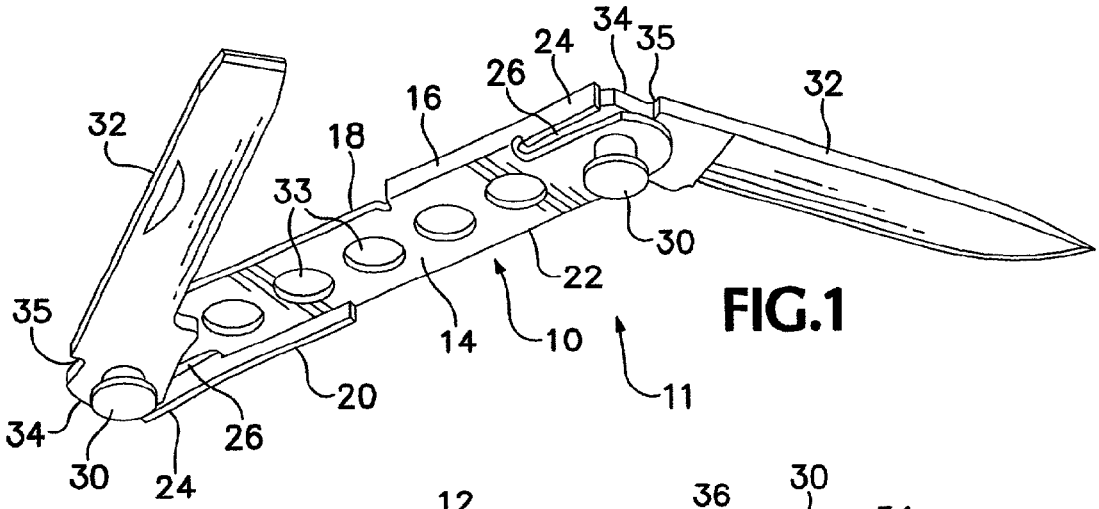
FIG. 1 is an isometric view of a folding tool, with the side scales omitted, including a first embodiment of a frame member according to the present invention.

FIGS. 1 and 4–6 show a first embodiment of a frame member 10. An elongate plate 14 includes an integral, elongate partial upper flange 16 and an integral, elongate partial lower flange 20. Both flanges extend outwardly from the plate in generally opposite directions, the upper flange 16 extending outwardly in a first direction along a portion of the upper edge 18 of the plate, and the lower flange 20 extending outwardly in a second direction along a portion of the lower edge 22 of the plate. In the exemplary embodiment the plate 14 is essentially planar and the flanges 16, 20 are oriented substantially perpendicular to the plate. Each flange 16, 20 includes an integral elongate leaf spring 24 at the outer end of the flange proximate an end of the plate. The portion of the flange that comprises the leaf spring 24 is separated from the adjacent portion of the plate 14 by an elongate cut 26. Lightening holes 33 in the plate 14 reduce the weight of the tool 11 by removing excess material.

Figure 19:
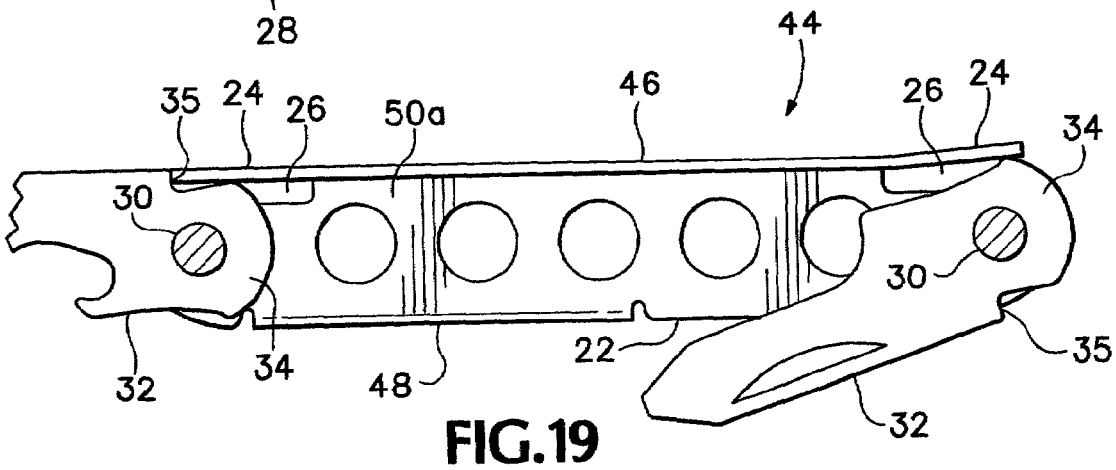
FIG. 19 is a side view of a folding tool, with the side scales omitted, including the frame embodiment of FIGS. 3 and 16–18.

Referring to FIGS. 5 and 6, plate 14 includes openings 28 at each end. As shown by the tool 11 in FIG. 1, these openings 28 are positioned to receive pivot pins 30 on which blades or tool bits 32 can be pivotably mounted. ("Tool bits" as used herein includes blades, pliers, scissors or other such implements.) When tool bits 32 are attached to the frame member 10, the leaf springs 24 associated with the upper and lower partial flanges 16, 20 bear forcefully upon the bases 34 of the respective tool bits 32. As shown in FIGS. 1 and 19, the bases 34 of the tool bits are cam-shaped such that the force of the spring upon the base of the bit tends to retain the bit in either folded or extended position. In order to move between folded and extended condition sufficient force must be applied to the tool bit 32 to overcome the spring force and bend the spring 24 upwardly away from the pivot pin 30.

FIG. 1 shows a tool bit 32, in this case a knife blade, pivotably mounted by a pivot pin 30 to the far side of plate 14, with the leaf spring 24 associated with partial upper flange 16, engaging the base 34 of the blade. As shown in further detail in FIG. 19, the end of spring 24 provides an abutment against which a step 35 in base 34 of the tool bit 32 can rest, preventing further rotation and providing axial support for the knife blade. A second tool bit 32, a screwdriver blade, is pivotably mounted by pivot pin 30 to the near side of plate 14. The leaf spring 24 associated with the partial lower flange 20 engages the base 34 of the screwdriver blade 32.

Figure 2:
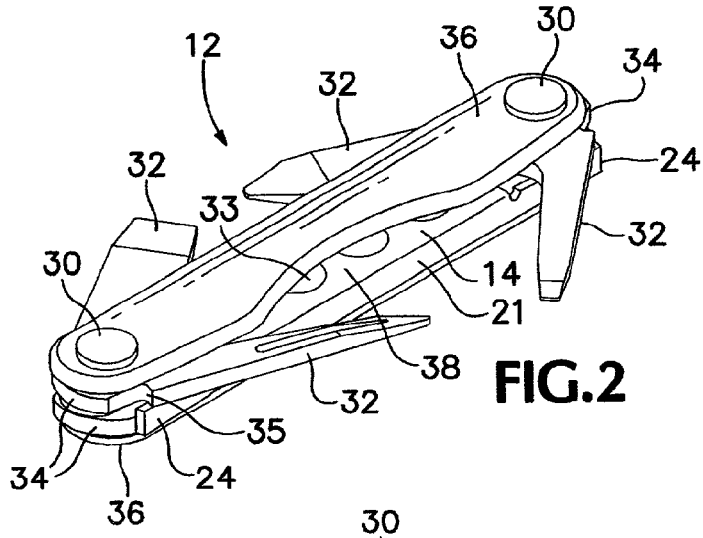
FIG. 2 is an isometric view of a folding tool including a second embodiment of a frame member according to the present invention.
Figure 3:
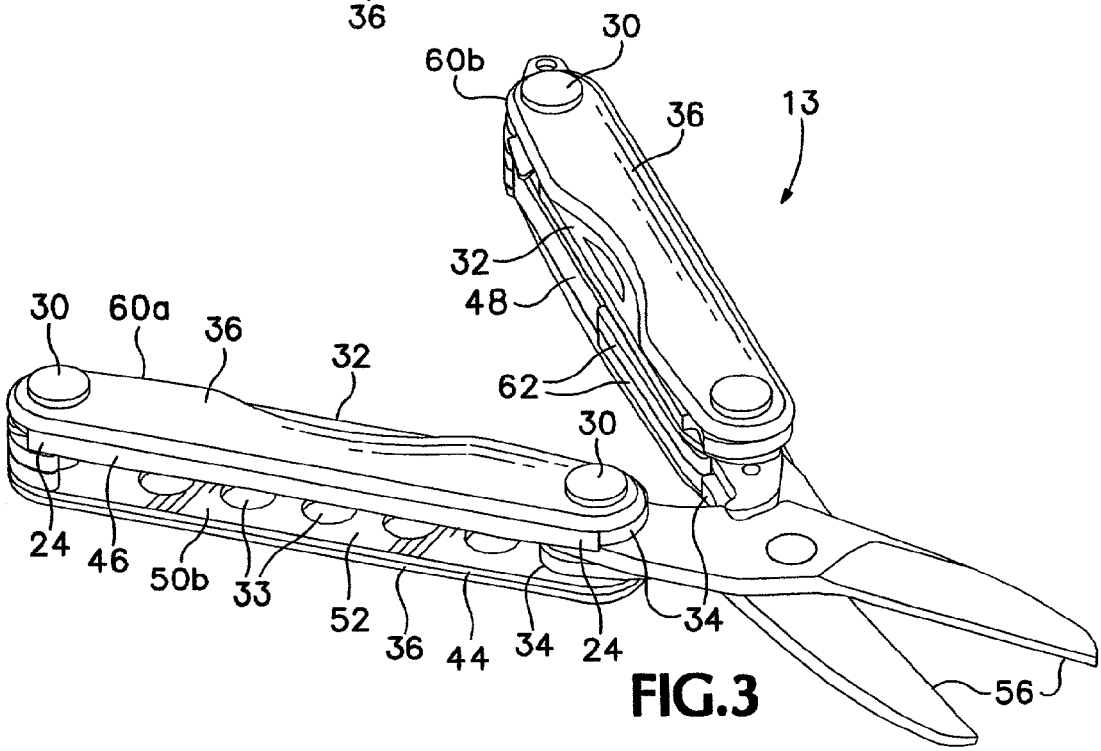
FIG. 3 is an isometric view of a folding tool including a third embodiment of a frame member according to the present invention.

Side scales 36, such as those disclosed in FIGS. 2 and 3, can be attached to the tool assembly of FIG. 1 by pivot pins 30 creating opposite facing tool pockets for receiving folding tool bits. In FIG. 1, a downwardly facing tool pocket on the far side of the plate would be defined by the plate 14, a far side scale, and the partial upper flange 16 with spring 24. The knife blade 32 can be stored in this pocket and pivot downwardly out of the pocket toward an extended position at one end of the plate. Similarly, an upwardly facing tool pocket on the near side of the plate would be defined by a near side scale, the plate 14 and the partial lower flange 20 with leaf spring 24. The screwdriver blade 32 can be stored in this pocket and pivot upwardly out of the pocket toward an extended position at the other end of the plate.

Figure 11:
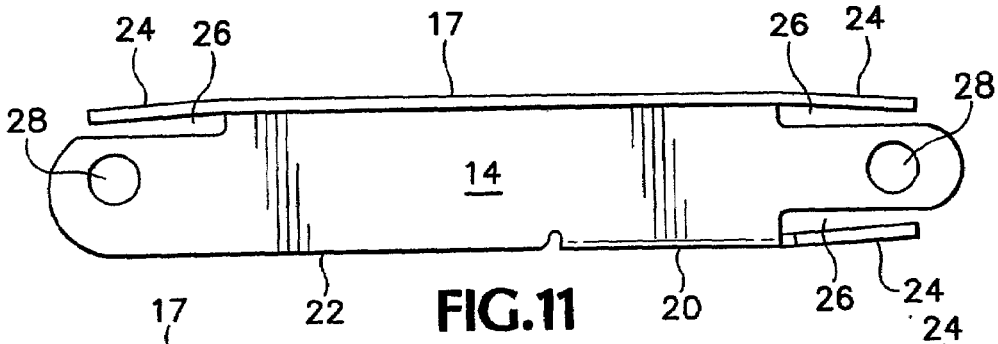
FIGS. 10, 11 and 12 are three views, respectively an end view, side view and isometric view, of another embodiment of a frame member according to the present invention.
Figure 10:
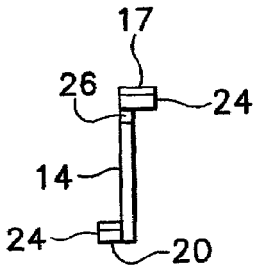
Figure 12:
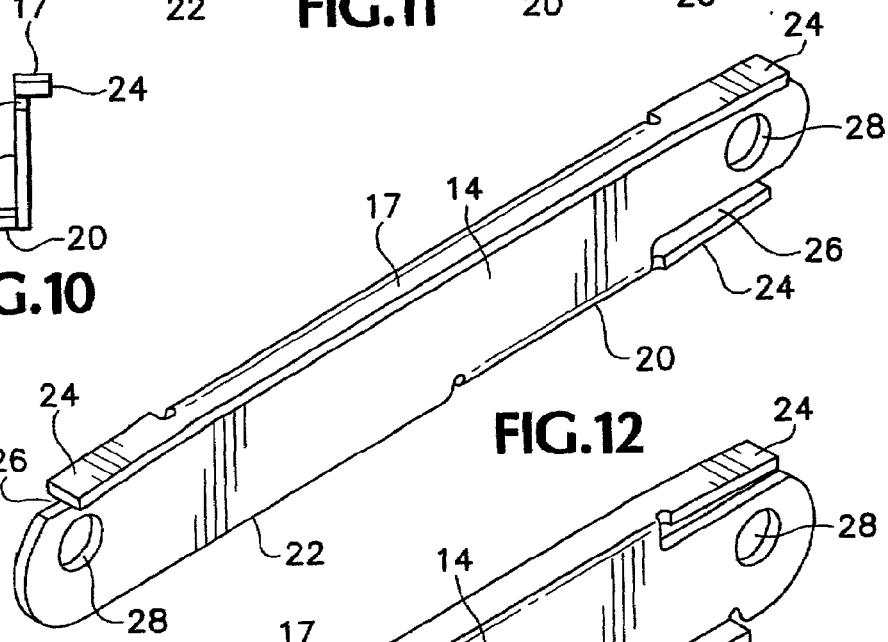

FIGS. 10–12 show a frame member similar to that shown in FIGS. 1 and 4–6. However, the embodiment of FIGS. 10–12 includes a full upper flange 17 extending along the entire upper edge of the plate 14. The full upper flange includes a second leaf spring 24 at the end of the flange opposite the first leaf spring. The second spring allows additional tool bits to be positioned on the near side of the plate. Although the drawings show a single tool bit interacting with a particular leaf spring, a single spring could engage more than one tool bit.

FIGS. 7–9 show a further embodiment of a frame member. This embodiment has a full upper flange 17 with leaf springs at both ends of the flange, and a full lower flange 21 with leaf springs 24 at both ends, enabling tool bits 32 to be arranged at both ends of the plate on both sides of the plate. FIG. 2 shows a tool 12 including a frame member as shown in FIGS. 7–9, and further including tool bits 32, pivot pins 30 and side scales 36. The side scales 36 cooperate with the flanges 17, 21, springs 24 and plate 14 to form two tool pockets 38, one on each side of the plate. The near tool pocket 38 faces downwardly and the tool bits 32 pivot downwardly out of the pocket 38 from each end of the tool. The far tool pocket faces upwardly and two tool bits 32 pivot upwardly out of the pocket from each end of the tool. As may be seen from FIG. 2, tool bits 32 on the same end pivot in opposite directions, as do tool bits in the same pocket.

Figure 15:
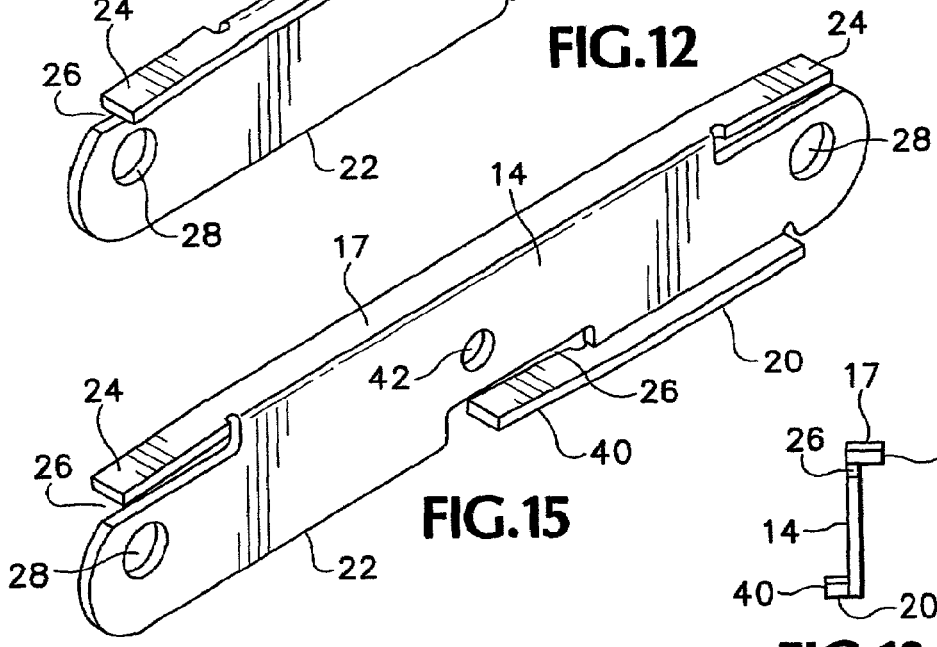
FIGS. 13, 14 and 15 are three views, respectively, an end view, side view and isometric view, of a further embodiment of a frame member according to the present invention.
Figure 13:
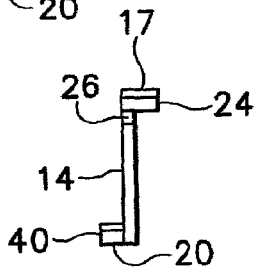
Figure 14:
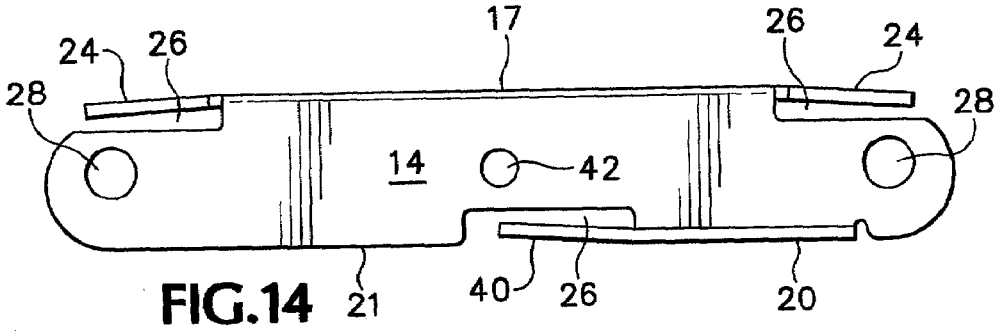
Figure 17:
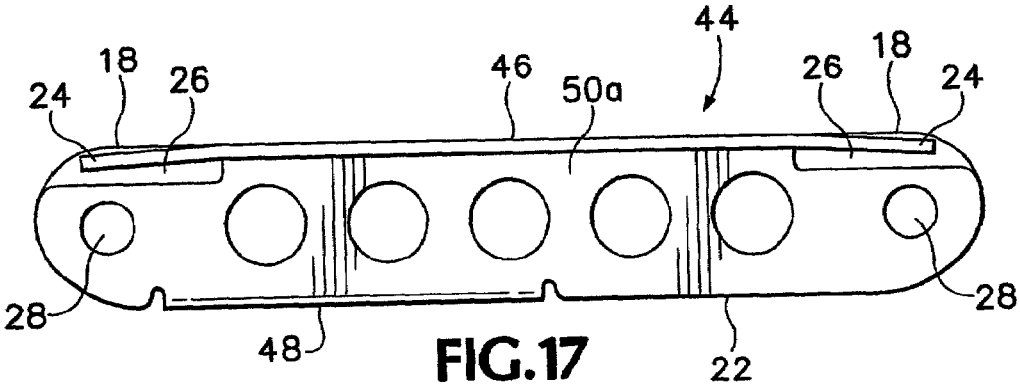
FIGS. 16, 17 and 18 are three views, respectively an end view, side view and isometric view, of the frame embodiment of FIG. 3.
Figure 16:
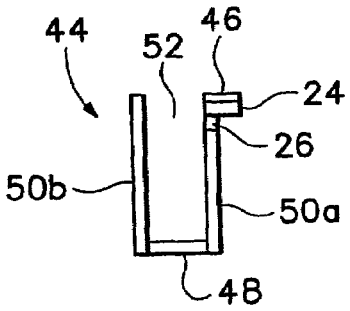
Figure 18:
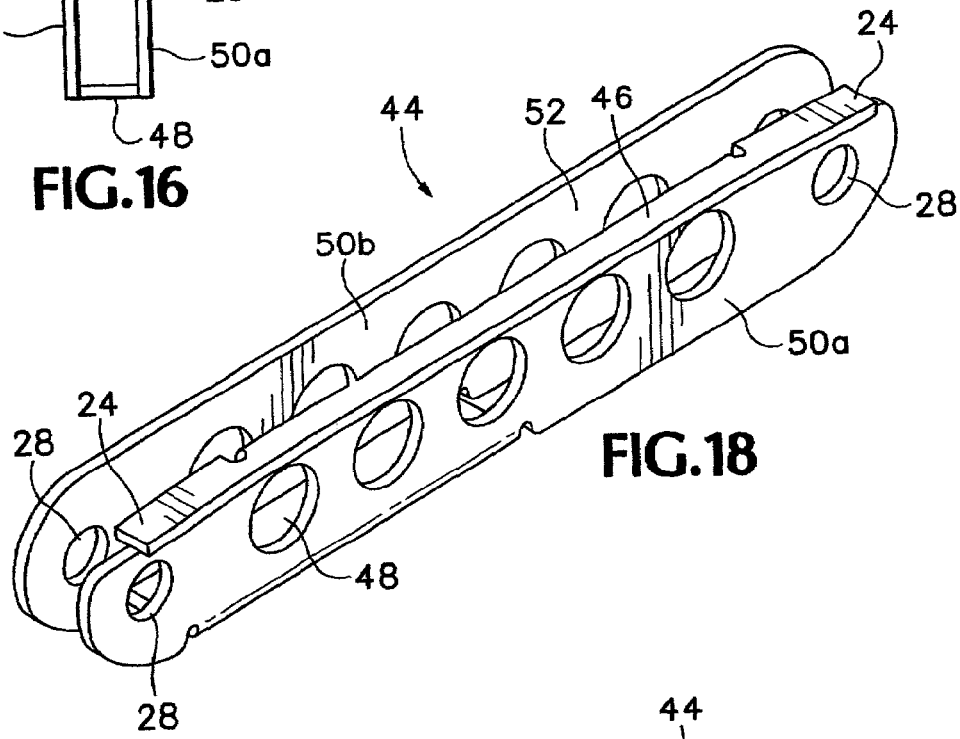

FIGS. 13–15 show a further embodiment of the frame member, similar to that shown in FIGS. 10–12, except that this embodiment includes an intermediate leaf spring 40 associated with the partial lower flange 20. The intermediate leaf spring 40 is located on an inner end of the partial lower flange proximate the middle of the plate 14 rather than out at the end of the flange proximate the end of the plate. The intermediate spring 40 facilitates mounting an intermediate tool bit not shown, such as corkscrew or awl, that is adapted to be used in an extended position substantially perpendicular to the general orientation of the plate. An intermediate hole 42 in plate 14 is capable of receiving a pivot pin about which an intermediate tool bit could pivot between folded and extended positions.

As can be seen from the end views of the frame members in FIGS. 4, 7, 10 and 13, the frame embodiments of FIGS. 1, 2 and 4–15 are all "z-shaped" with plate 14 arranged centrally and upper and lower flanges 16, 17, 20 and 21 extending outwardly from upper and lower edges on opposite sides of the plate, thus enabling pivoting tool bits 32 to be carried on both sides of the plate. The flanges may extend only partially along the upper 18 or lower 22 edges of the plate as shown in FIG. 6, along the entire length of the plate as shown in FIG. 9 or combinations of partial and full, upper and lower, as shown in FIGS. 10–12 and 13–15. Leaf springs may be located at ends of the flanges proximate the ends of the plate, or at an end of a partial flange toward the middle of the plate as shown in FIGS. 13–15. These embodiments of the z-shaped frame member are only exemplary and other embodiments not shown may be within the scope of the invention as defined by the claims.

FIGS. 16–19 show a different general type of frame member, namely a channel-shaped frame member with an external flange. Referring first to FIGS. 16–19, a channel-shaped frame member 44 includes an integral full external flange 46 extending outwardly along the upper edge of plate 50*a* and a partial internal flange 48 extending outwardly from the lower edge of plate 50*a* in a direction generally opposite the external flange 46. The internal flange 48 is integral with and co-joins opposed plates 50*a* and 50*b*. The full external flange includes two leaf springs 24, one at each end of the flange. As described above and shown in FIG. 19, these leaf springs 24 bear upon the cam-shaped bases 34 of tool bits 32 which are pivotably attached to the frame member 44 by pivot pins 30 arranged in openings 28. As may be seen in FIGS. 16 and 18, the frame member 44 is channel-shaped with plates 50*a* and 50*b* serving as channel walls, and the partial internal flange 48 serving as a channel floor. The channel-shaped frame member 44 defines an upwardly facing internal tool pocket 52 within the channel. This internal tool pocket 52 may be seen in the lower handle of the tool 13 shown in FIG. 3. The addition of side scales to the embodiment shown in FIGS. 16–19 would create a second, downwardly facing, external tool pocket adapted to receive tool bits 32 such as shown in FIG. 19.

Figure 27:
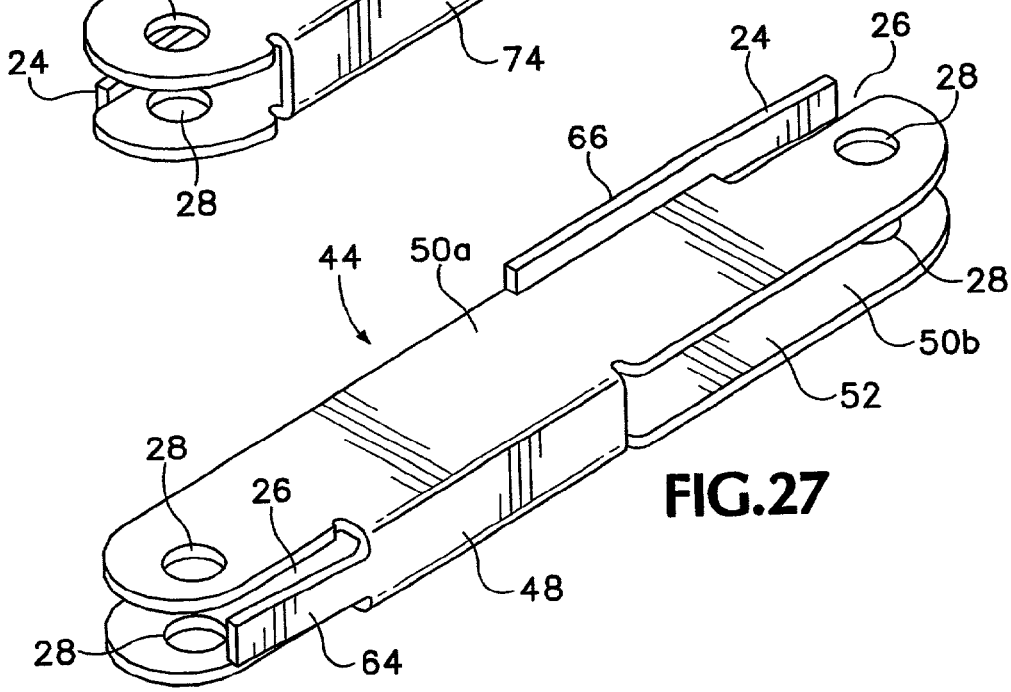
FIG. 27 is an isometric view of a further embodiment of a frame member according to the present invention.

Turning to FIG. 27, a channel-shaped frame member 44 has an integral partial external flange 66 and an integral partial internal flange 48. The partial internal flange includes an internal leaf spring 64 positioned to interact with tool bits stored in the internal tool pocket 52, while the spring 24 of the partial external flange is positioned to interact with tool bits carried on the other side of plate 50*a* and stored in an external tool pocket.

A partial internal flange 48 shown in FIGS. 16–18 and 26 accommodates use of independent springs similar to those shown in U.S. Pat. No. 5,745,997 to interact with tool bits stored in the internal tool pocket and pivotable about a pivot pin, not shown, at the right hand end of the frame member 44.

FIG. 3 illustrates a folding multipurpose tool including channel-shaped frame members with an external flange as shown and described in FIGS. 16–19. In this case, the folding scissors tool 13 includes two handles 60*a* and 60*b*, each having a frame member 44 as described above. Referring to the lower one of the handles 60*a* shown in FIG. 3, the side scale 36 obscures a clear view of plate 50*a*, but the full external flange 46 extending outwardly from plate 50*a* may seen. Plate 50*b* with lightening holes 33 is clearly visible in tool pocket 52. A tool bit 32 is shown folded in the external tool pocket. Leaf spring 24 at the scissors end of the handle engages the base 34 of tool bit 32. When tool 13 is fully folded, one of the scissor blades 56 is received in the internal tool pocket 52.

Further details of the handles are discernable from the view of the upper handle 60*b*. Tool bit 32 is located in the external tool pocket. The partial internal flange 48 is visible as are two independent springs 62 located within the channel and positioned to bear against the base 34 of the scissors blades 56.

While the frame embodiment shown in FIGS. 16–19 is shown in FIG. 3 the context of a two-handled scissors tool 13, it could also be used with a single-handled tool such as shown in FIGS. 1 and 2.

In the embodiment shown in FIGS. 3, 16–19 and 26, the inner flange 48 does not extend the length of the opposed plates 50*a* and 50*b*, and independent springs 62 shown in FIG. 3 are used to bear upon the bases 34 of the scissor blades 56. However, as shown in FIG. 27, an internal leaf spring 64 may also be used to interact with folding tool bits located within the channel formed by the channel-shaped frame member 44. The internal leaf spring 64 could be used alone, or in combination with independent springs. The internal flange 48 could extend the length of the frame member 44, and could include more than one leaf spring, one at either end of the flange, for example, to act on tool bits. Similarly, independent springs could be used to bias tool bits pivotably mounted in the internal tool pocket at both ends of the channel-shaped frame member. For example, although the partial internal flanges 48 are shown herein as being located toward one end of the channel, they could be located centrally within the channel as disclosed in applicant's co-pending application, Ser. No. 09/703,369, leaving room for independent springs to act on tool bits at both ends of the channel. As described with regard to the z-shaped frame member, the channel-shaped frame member with external flange can be configured in a variety of arrangements, all of which are not shown.

FIGS. 20–26 show embodiments of a channel-shaped frame member with two external flanges. Referring first to the specific embodiment shown in FIGS. 20–22, an elongate channel-shaped frame member 70*a* includes a full external upper flange 72 extending outwardly from the upper edge of side plate 50*b*, a partial internal flange 74 connecting side plates 50*a* and 50*b* and a partial external upper flange 76 extending outwardly from side plate 50*a*. All portions of frame member 70*a* are integral with each other. The full upper flange 72 includes two integral leaf springs 24, one at either end of the flange. Each of these springs 24 is capable of interacting with base 34 of at least one tool bit. The frame member 70*a* defines an upwardly facing tool pocket capable of receiving tools that are pivotable about pins extending between the two side plates 50*a* and 50*b* in openings 28 at either end of the frame. As described above, these tool bits may be biased by an internal leaf spring as disclosed in FIG. 27, or independent springs 62 as shown in FIG. 3. The partial external upper flange 76 includes a single leaf spring 24 at the outer end of the elongate partial flange. This spring is capable of interacting with the base of at least one tool bit. The addition of side scales, not shown in these figures, create two downwardly facing external tool pockets, one on either side of the internal, upwardly facing tool pocket.

Figure 23:
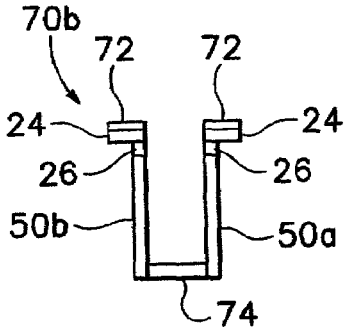
FIGS. 23, 24 and 25 are three views, respectively an end view, side view and isometric view, of a further embodiment of a frame member according to the present invention.
Figure 24:
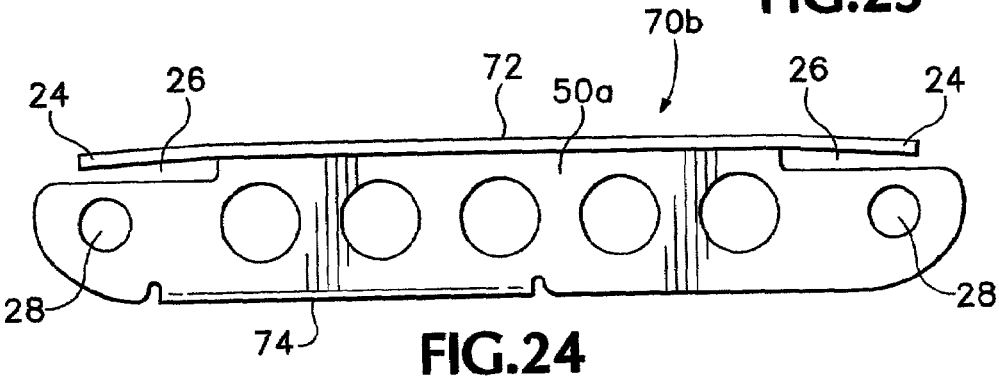
Figure 25:
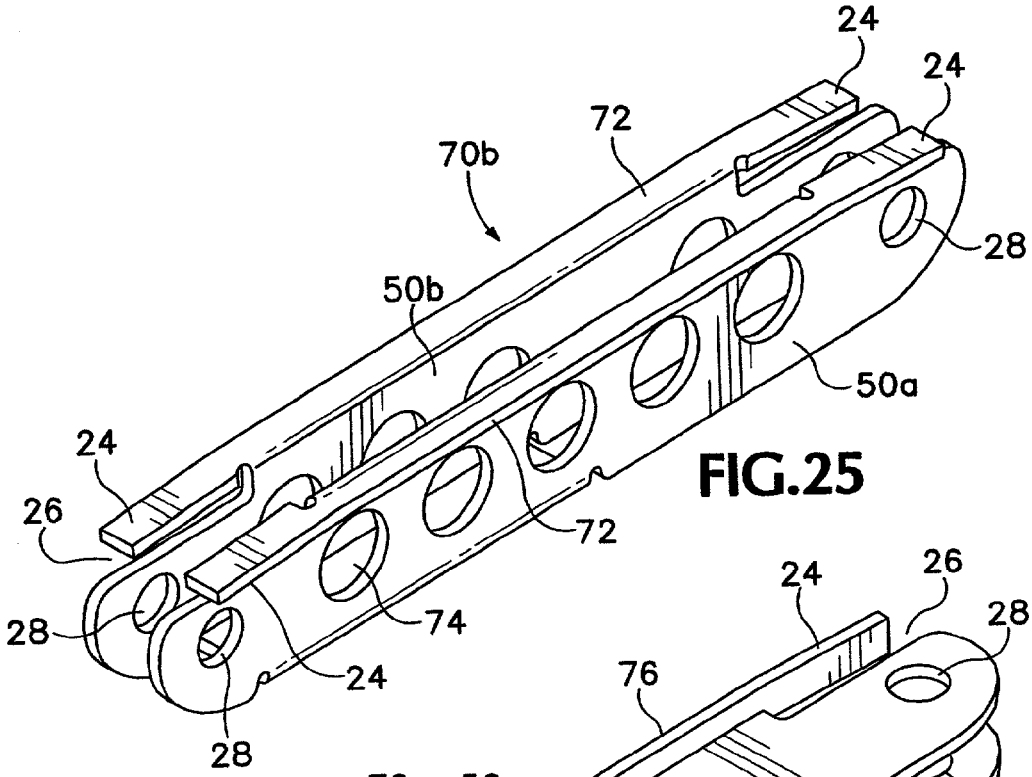

Turning now to the embodiment shown in FIGS. 23–25, an elongate channel-shaped frame member 70*b* includes a first full external upper flange 72 extending outwardly from the upper edge of plate 50*b*, and a partial internal flange extending outwardly from the lower edge of plate 50*b* and connecting plate 50*b* to the lower edge of plate 50*a*. A second full upper external flange 72 extends outwardly from the upper edge of 50*a*. Addition of side scales would again create two downwardly facing external tool pockets, except this frame embodiment includes a second leaf spring 24 on the second full external upper flange 72 enabling mounting at least one other folding tool bit in the external tool pocket adjacent side plate 50*a*.

Figure 21:
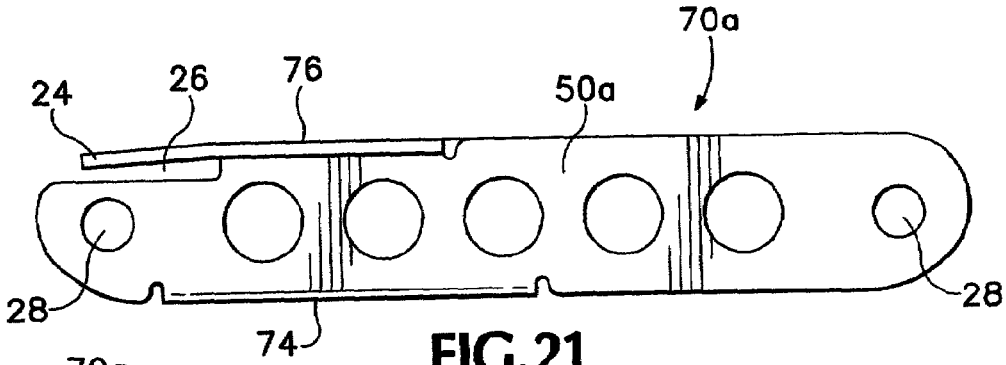
FIGS. 20, 21 and 22 are three views, respectively an end view, side view and isometric view, of a further embodiment of a frame member according to the present invention.
Figure 20:
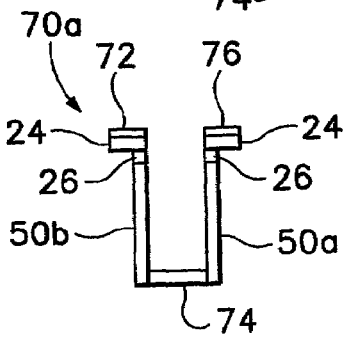
Figure 22:
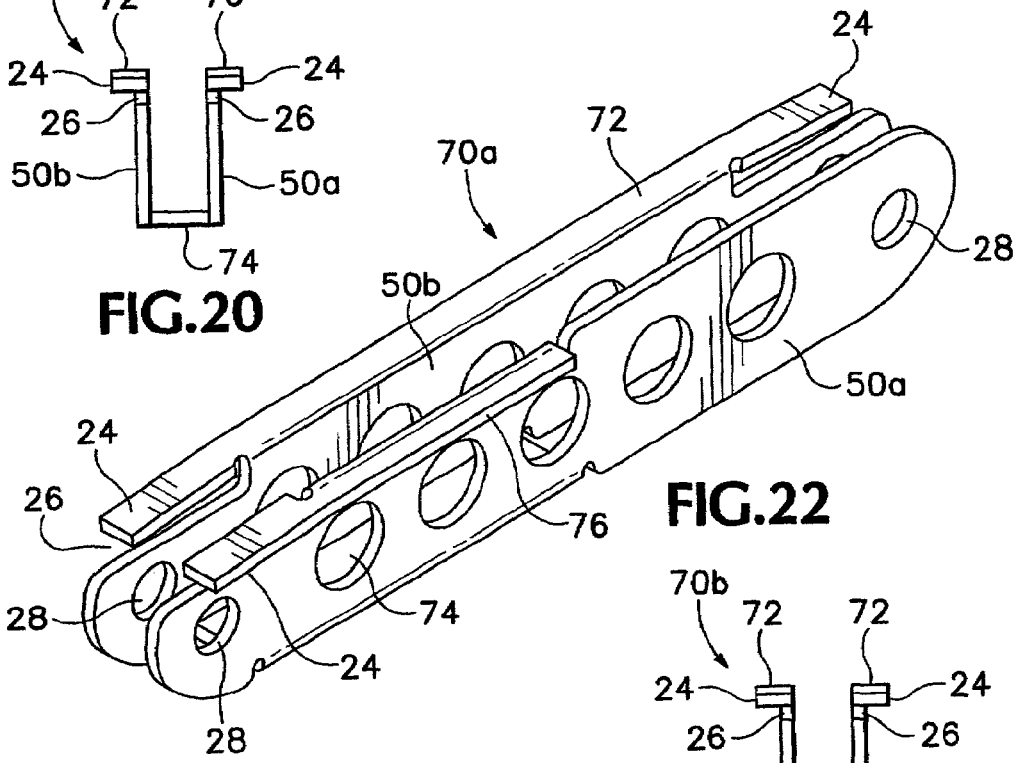
Figure 26:
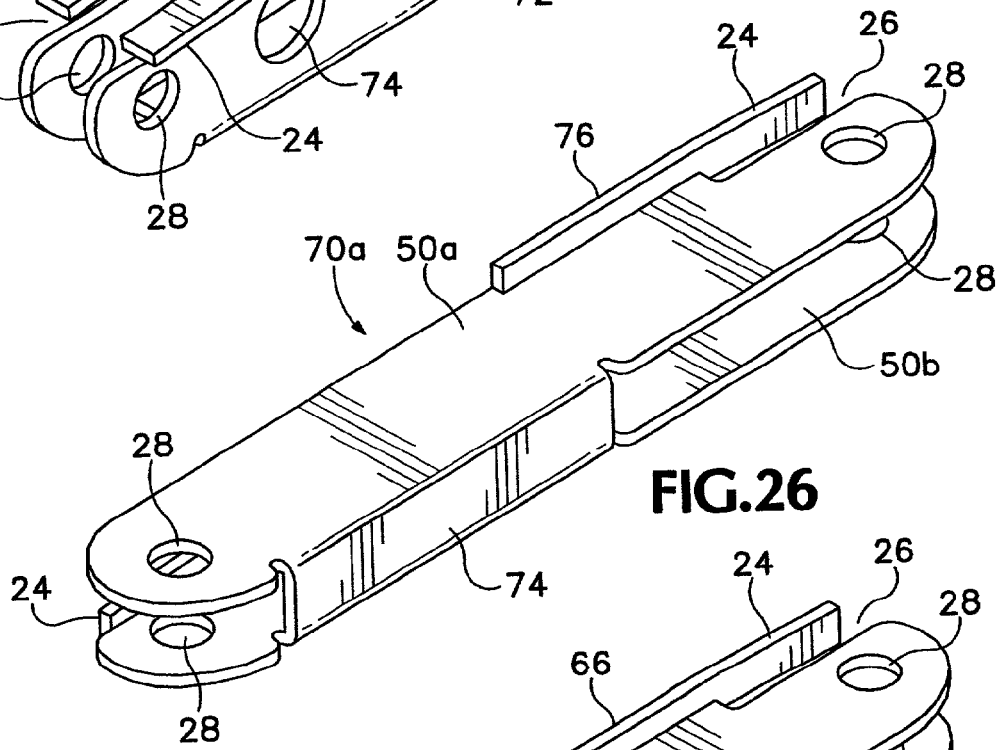
FIG. 26 is an isometric view of a further embodiment of a frame member according to the present invention.

FIG. 26 is another view of the frame member 70*a* shown in FIGS. 20–22 with a full external upper flange 72, not shown, extending outwardly from side plate 50*b* and a partial external upper flange 76 extending outwardly from side plate 50*a*. The frame member 70*a* shown in FIG. 26 is oriented to provide a clear view of the bottom portion of the frame showing how the partial internal flange 74 extends outwardly from side plates 50*a* and 50*b* in a direction substantially opposite the extension of flanges 72 and integrally joins side plates 50*a* and 50*b*. Although the Figures show the channel-shaped frames 44, 70*a* and 70*b* with partial internal flanges, a tool with a full internal flange is within the scope of the invention.

In the preferred embodiments shown herein the frame members 10, 44, 70*a* and 70*b* are constructed from a single piece of sheet metal bent to form plates and flanges, and cut to create the leaf springs. While the exemplary embodiments show the flanges extending outwardly from the plates in a direction substantially perpendicular to the plate, this arrangement is not necessary and other orientations are possible. Similarly, while the exemplary embodiments show the plates as planar, this is not considered to be crucial to the invention. Also, while the plates and flanges are shown herein as parallel, this is not a requirement. Further, it is not necessary to have a spring at both ends of the a full flange. Nor is it necessary that a spring bear upon a base of a tool blade. For example, a frame member having a full flange and a spring at both ends of the flange could have a tool bit 32 associated with one flange, and use a spacer to engage the other spring. Although the embodiments disclosed herein show the springs 24 bent downwardly toward the frame, it is not necessary that the springs be preloaded in this fashion.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A handle for a folding tool comprising:

(a). a first piece of integral material defining only one integral channel, said channel including first and second opposed side walls and a channel floor defining an internal pocket, said channel further including a first external flange, integral with said first piece of integral material, extending outwardly from said first side wall in a first direction away from said channel, said first external flange including a first leaf spring also integral with said first piece of material; and (b). a first side scale, separate from and not an integral part of said first piece of integral material, said first side scale secured to said channel adjacent to said first external flange such that said first side wall, said first external flange and said first side scale define a first external pocket.

2. The handle of claim 1 wherein said first piece of integral material is sheet metal.

3. The handle of claim 1 wherein said first side scale is consists of a second piece of integral material.

4. The handle of claim 1 including:

(a). a second external flange, integral with said first piece of integral material, extending outwardly from said second side wall in a second direction away from said channel, said second external flange including a first leaf spring that is an integral part of said first piece of integral material; and (b). a second side scale, separate from and not an integral part of said first piece of integral material, secured to said frame member adjacent to said second external flange such that said second side wall, said second external flange, and said second side scale define a second external pocket.

5. The handle of claim 4 wherein said internal pocket faces in a third direction and said first and second external pockets face in a fourth direction substantially opposite to said third direction.

6. The handle of claim 4 wherein said first leaf spring of said second external flange is defined by only one cut in said first piece of integral material.

7. The handle of claim 6 wherein said cut is straight and parallel to said second external flange.

8. The handle of claim 1 wherein said first leaf spring is defined by only one cut in said first piece of integral material.

9. The handle of claim 8 wherein said cut is located substantially in said first sidewall.

10. The handle of claim 9 wherein said cut is straight.

11. The handle of claim 9 wherein said cut is parallel to said first external flange.

12. The handle of claim 1 including an independent spring, separate from and not an integral part of said first piece of integral material, arranged in said internal pocket.

13. The handle of claim 12 further including a first tool bit positioned in said internal pocket, said independent spring positioned in said pocket so as to bear upon said first tool bit.

14. The handle of claim 13 wherein said first tool bit is a scissors blade.

15. The handle of claim 13 wherein said first tool bit is a pliers jaw.

* * * * *

UNITED STATES PATENT AND TRADEMARK OFFICE

CERTIFICATE OF CORRECTION

PATENT NO. : 7,182,001 B2
APPLICATION NO. : 10/066087
DATED : February 27, 2007
INVENTOR(S) : Benjamin C. Rivers It is certified that error appears in the above-identified patent and that said Letters Patent is hereby corrected as shown below:

Column 4, lines 48-49
Change "50*a* may seen" to read --50*a* may be seen--.

Column 6, line 16
Change "of the a full flange" to read --of a full flange--.

Column 6, lines 53-54
Change "scale is consists" to read --scale consists--.

Signed and Sealed this

Twenty-sixth Day of February, 2008

JON W. DUDAS
*Director of the United States Patent and Trademark Office*